United States Patent [19]

Wells

[11] Patent Number: 4,490,882

[45] Date of Patent: Jan. 1, 1985

[54] UPRIGHT VACUUM CENTER

[76] Inventor: R. Leon Wells, 1649 Manor Dr., Vista, Calif. 92083

[21] Appl. No.: 514,551

[22] Filed: Jul. 18, 1983

[51] Int. Cl.[3] ..... A47L 5/32

[52] U.S. Cl. ..... 15/337; 15/349; 15/391

[58] Field of Search ..... 15/337, 349, 354, 355, 15/356, 363, 364, 365, 366, 368, 369, 370, 372, 383, 384, 386, 388, 391

[56] References Cited

U.S. PATENT DOCUMENTS

| | | | |
|---|---|---|---|
| 1,184,459 | 5/1916 | Kirby | 15/337 X |
| 1,421,958 | 7/1922 | Kirby | 15/349 X |
| 2,257,555 | 9/1941 | Troxler | 15/337 |
| 2,266,075 | 12/1941 | Replogle | 15/349 X |
| 2,797,430 | 7/1957 | Thornwald | 15/337 X |
| 3,184,775 | 5/1965 | Downey et al. | 15/349 X |

*Primary Examiner*—Chris K. Moore
*Attorney, Agent, or Firm*—John J. Murphey

[57] ABSTRACT

An upright-type vacuum cleaner wherein the air pump, traditionally fixed to the bottom motor shaft, is repositioned at the top of the motor shaft and the dirt-laden air duct is directed up over the motor to this top mounted air pump, and a radical change of direction is introduced in the air duct to cause heavy debris fragments, that would normally enter and damage the air pump, to drop out of the incoming air stream into an emptyable receptacle.

9 Claims, 3 Drawing Figures

UPRIGHT VACUUM CENTER

BRIEF SUMMARY OF THE INVENTION

This invention pertains to an apparatus for cleaning carpets, rugs, floors, etc., by suction, commonly known as a vacuum cleaner. More particularly, this invention pertains to those vacuum cleaners that comprise a rollable base containing suction means therein, connected to a push-pull handle where the user moves the base in a back-and-forth motion over the floor, commonly called an upright vacuum cleaner.

Historically, upright vacuum cleaner design has called for an electric motor with vertical shaft drive in the base where the suction means is located under the motor next to the floor, driven by the lower end of the motor shaft. A roller, containing a brush or other floor vibrating means, is put at the front of the base and driven by a belt that is also connected to the lower end of the motor shaft. Debris vibrated loose from the rug, carpet, etc. (floor) is swept along with air directly into the suction fan and thence discharged into the air-debris separator bag that is hung or suspended from the push-pull handle. Many problems have been encountered with this design; most of them not correctable.

For instance, all stress on the motor shaft takes place at the lower end thereof where the suction fan and the floor vibrating means are connected. Where they split between the two ends of the shaft, bearing stress would be normalized and bearing wear reduced. In addition, the roller drive belt is fully within the incoming air-debris stream thereby subjecting it to early failure from impact with large debris fragments. Furthermore, the hose, for connecting small attachments to the vacuum cleaner, must be connected to the bottom of the vacuum cleaner base through coupling with a wide plate that, because of so many mating edges allowing leakage, resulting in only moderate suction power to the attachments.

Additionally, modern trends in vacuum cleaner design utilize plastic and cast metal wherever possible to save weight and reduce manufacturing costs. Thus, the suction fan is now made of plastic and most vacuum cleaner bases are either injection molded plastic or cast aluminum alloy. Fragments coming in with the air-debris stream act like bullets and rip, tear, puncture and sometimes break the plastic fan blades, plastic fan base and the air-debris separator bag. Should one of the fan blades break from impact with a paperclip, button, nail, screw, coin or other fragment, the fan immediately becomes unbalanced and, with the high fan speeds, will cause total bearing failure within minutes.

This inventive vacuum cleaner design has the suction fan and roller belt drive separated to opposite ends of the vertical motor shaft thus normalizing stress on the shaft bearings and lengthening service life. The suction fan is removed from under the motor to overtop thereof thus removing most of the roller belt drive from the incoming air-debris stream and the potential damage therefrom. The suction from under the floor vibrating rollers is now directed upwardly into an enclosed pathway over top of the drive motor.

A unique feature of this invention is that a radical change of upward airflow is purposely introduced between the floor vibrating rollers and the suction fan intake port. This reversal of direction allows heavy debris fragments, such as paperclips, stones, buttons, nails, screws, etc. to drop out of the air stream before they can enter the suction fan intake port and cause damage to the fan as hereinbefore described. A tray is provided below the radical change in airflow direction to receive these heavy fragments and means are provided to allow the receptacle to be easily emptied.

In addition, this unique construction allows the attachment hose to be easily and conveniently plugged into the top of the vacuum cleaner base, directly into the suction fan intake port, thereby eliminating the leakage presently involved in such operations and increasing the suction power to the attachments.

Accordingly, one object of this invention is a means of normalizing stress on the drive motor shaft for improved service life. Another object is a means of eliminating most of the exposure of the roller drive belt from the damaging effects of fragments and other debris in the incoming air-debris stream. A further object of this invention is a vacuum cleaner that automatically eliminates large fragments of debris from the incoming air-debris stream before they have a chance to enter the suction fan and damage the fan blades or fan chamber. A still further object of this invention is a means to extend the useful life of plastic parts and cast metal parts presently used in modern upright vacuum cleaners. Additionally, another object of this invention is a means of allowing attachment hose connection directly into the intake port of the suction fan to provide more cleaning power to the vacuum cleaner attachments.

These and other objects of this invention will become more apparent to the reader by reading the following detailed description of the preferred embodiments together with the drawings attached hereto and ending with the claims that define the scope of protection sought by the inventor.

DETAILED DESCRIPTION OF THE INVENTION

Figure 1:
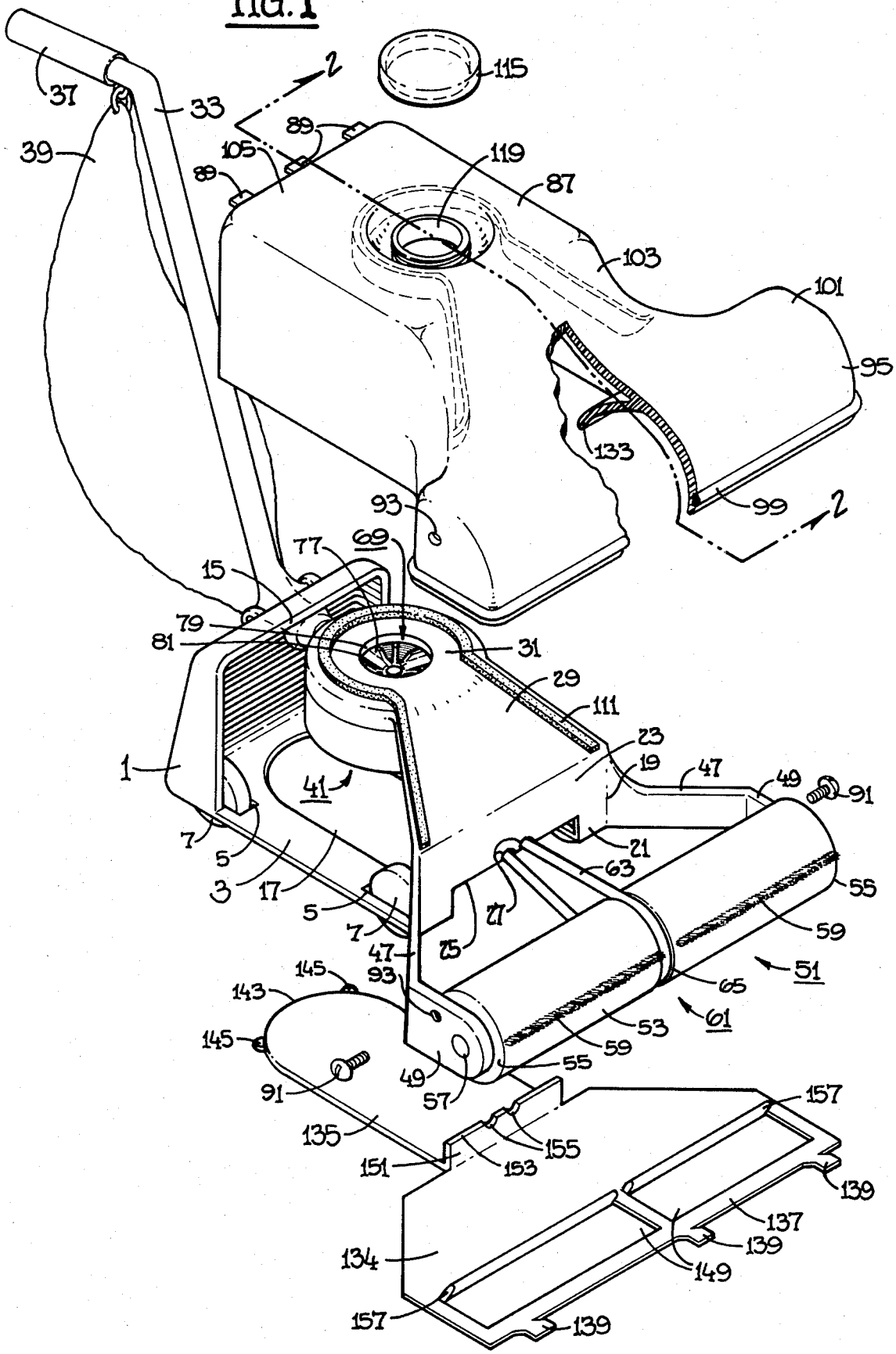
FIG. 1 is an isometric exploded view of the preferred embodiment of this invention.

Referring to the drawings, the vacuum cleaner of this invention is shown to comprise a vacuum cleaner base 1 that includes a base floor plate 3 containing slots 5 through which a set of rollable wheels 7 extend from axles 9 on mounts 11 for contact with the floor. Extending upward from the rear of floor plate 3 is a rear wall 13 terminating at a top rolled edge 15. A key-shaped opening 17 extends from the middle of plate 3 forward and outward to form a pair of front base corners 19.

A pair of front base wall posts 21 extends upward from said front base corners 19 to support a front base wall 23 that includes a lower wall edge 25, containing a pair of half-circle cut-outs 27 through which a drive belt passes (described later), a slanted wall portion 29 integral therewith and further extending rearward to form a motor support platform 31 that is horizontal and parallel to base floor plate 3.

An upright staff 33 connects base 1, through a flexible connection at rear wall 13, shown as hinge 35, to a push-pull handle 37. Suspended from staff 33 and/or handle 37 is an air-debris separator bag 39.

Rotary power means 41, such as an electric motor, is mounted on motor support platform 31 with its rotary power shaft vertically oriented in base 1 to provide upper and lower drive shaft ends 43 and 45 respectively. While an electric power cord, switch and plug are required in the operation of all electric vacuum cleaners, including the one of this invention, they are not shown in these drawings to allow a clearer view of the various parts of this invention.

From front base wall posts 21 extend forwardly and outwardly a pair of support wings 47 having the outer ends thereof formed into a pair of mutually parallel support arms 49. Between said arms 49 is positioned floor vibrating means 51, shown here as a cylindrical roller 53 of finite length, held transverse to the normal back-and-forth path of base 1, whose ends 55 are journaled in support bearings 57, such as a pair of dust-sealed ball bearings housed in arms 49. A series of protuberances such as brushes 59 extend from the surface of roller 53, generally from one end 55 to the other end 55, and are utilized to sweep against or otherwise produce vibration when roller 53 is rotated against the floor. A drive belt means 61, shown here as an endless rubber power belt 63 stretched between a circumferential groove 65 in roller 53, under half-circle cut-outs 27 and around the pulley 67, mounted on lower drive shaft end 45, provides rotary motion to roller 53 during cleaning operations.

Atop rotary power means 41 is air pump means 69 connected directly to upper power means drive shaft end 43. Means 69 may be of many types such as an impeller pump or, more frequently and as shown here, a centrifugal air fan 71 comprising an involute-shaped fan chamber 73 enclosing a fan plate 75, mounted on upper shaft drive end 43, upon which a series of radially mounted fan blades 77 are attached to spin at high speed and draw or suck air into an axial inlet port 79, defined by an inlet opening 81 formed in motor support platform 31, and discharging it at higher pressure through a side outlet port 83 through rear wall 13 and through a short discharge hose 85 into air-debris separator bag 39.

A lightweight base cover 87 is operably positioned over base 1, held in place by a series of rear attachment tabs 89, that engage the underside of rolled edge 15, and a pair of screws 91 that fit through a pair of matched holes 93 in cover 87 and support arms 49. Cover 87 is comprised of a front bumper portion 95 containing an outer groove 97 into which is received an elastic bumper 99, to prevent damage to furniture, etc., a front roller housing portion 101, a slanted duct portion 103 extending rearwardly therefrom and a rear top portion 105 extending overtop of power means 41. A rear cover wall 107 extends downward from top portion 105 and around the rear of inlet port 79 to engage motor support platform 31 to form, along with the rest of cover 87 and in cooperation with front base wall 23, slanted wall portion 29 and motor support platform 31 an enclosed duct 109 running from floor vibrating means 51 to inlet port 79 and sealed against air leaks by gasket 111 mounted in base 1 where it is in contact with cover 87.

Located in rear cover top portion 105 and centered over air pump means inlet port 79 is attachment hose connection means 113 for allowing direct connection of the vacuum cleaner attachment hose into inlet port 79. Means 113 may take a variety of forms; shown here it comprises a cap 115, adapted for receipt onto a hollow collar 117 forming an opening 119 in base cover 87, to seal duct 109 from air leakage when the hose is not in use. Collar 117 is formed in an annular depression 121, made in cover 87 to retain a minimum overall height to base 1 thus allowing the vacuum cleaner to enter low areas such as under furniture. A series of screw threads 123 is formed on the outside of collar 117 and on the inside of cap 115 to permit cap 115 to be screwed down tightly thereon.

Figure 3:
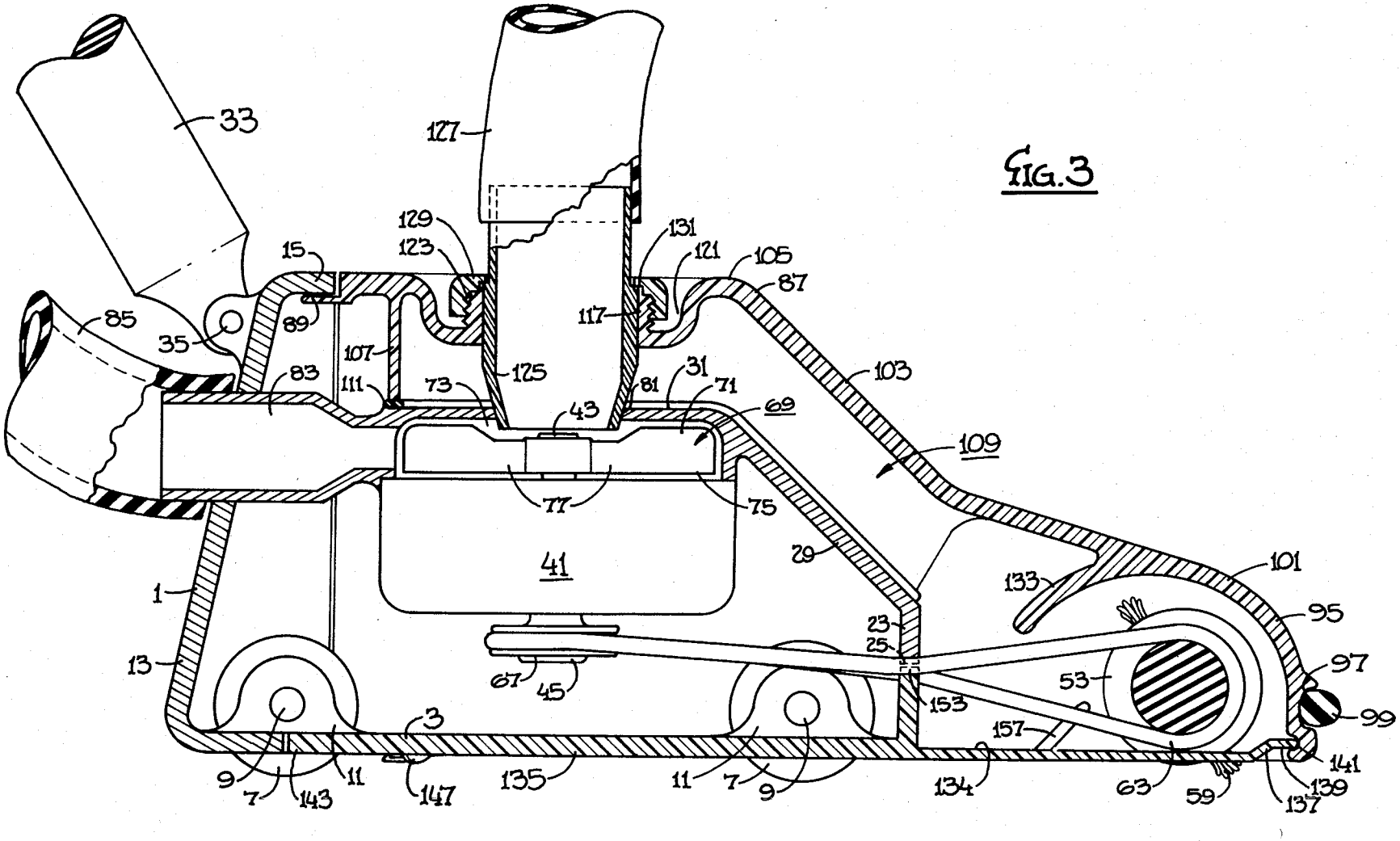
FIG. 3 is a sectional side view similar to FIG. 2 showing the addition of an attachment hose.

When it is desired to connect attachments, such as a dust brush, furniture brush, etc., to the vacuum cleaner, cap 115 is screwed off collar 117, and the neck 125 of attachment hose 127 inserted through opening 119 and into tight engagement with inlet port 79. As shown in FIG. 3, a securing collar 129 on hose 127 can be screwed down onto collar 117 to fasten neck 125 securely against cover 87 by abutment with boss 131 extending outward from the rear of hose neck 127. Other types of connection means such as bayonet clips, etc. may also be used and are fully contemplated within the scope of this invention.

Figure 2:
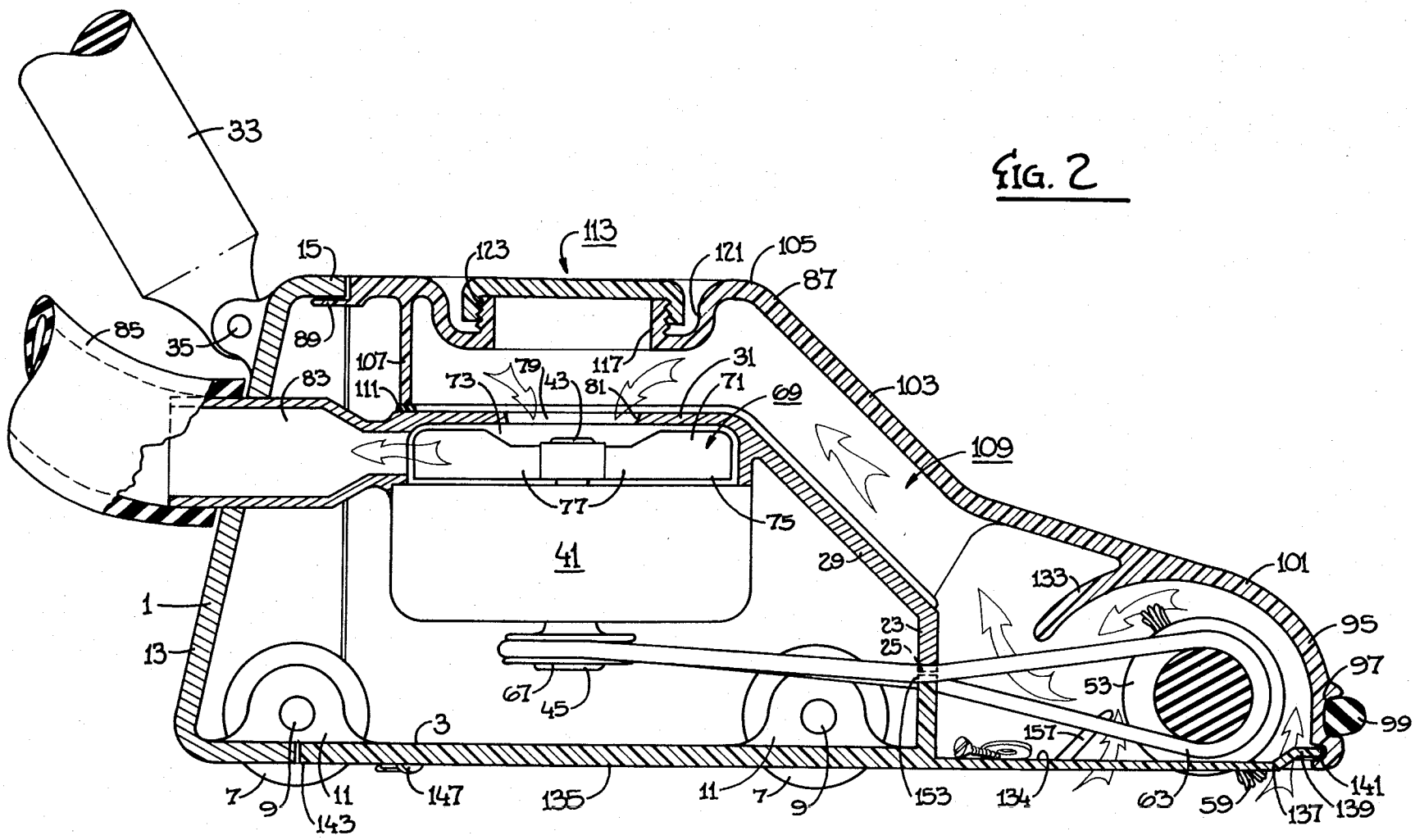
FIG. 2 is a sectional side view of the preferred embodiment taken along line 2—2 in FIG. 1.

Located somewhere in duct 109 but preferrably between front roller housing portion 101 and slanted duct portion 103 is a baffle 133 that extends part way down into duct 109. Baffle 133 interrupts the airflow stream causing a radical change of upward airflow in duct 109 as indicated by the flow arrows in FIG. 2 and causes heavy fragments of debris (shown in FIG. 2 as a screw and a washer) that would otherwise flow up duct 109 and pass into inlet port 79 and damage fan blades 77, to drop by gravity out of the air-debris stream.

A receptacle 134 is provided, to receive these debris fragments and to hold them until the vacuum cleaner is emptied, in the form of a pan 135, adapted to fit under base 1 over key-shaped opening 17 in base plate 3 and around the underside edge of floor vibrating means 51. Pan 135 is held in place along its front edge 137 by a plurality of tabs 139 attached thereto and adapted to fit into a slot 141 formed under the rear edge of front bumper portion 95 of base cover 87. Pan 135 is held in place at its rear curved edge 143 (and in the same plane as base floor plate 3) by tabs 145 that are held tight to floor plate 3 by ordinary twist clips 147. A pair of elongated openings 149 are formed in pan 135 positioned to fit below the outside edges of floor vibrating means 51 so that when assembled, the air flow duct into 109 is restricted to the immediate vicinity around roller 53. An upstanding wall 151 is provided on pan 135 to the rear of openings 149 and adapted to mate in abutting relationship with lower front base wall edge 25. The mating top edge 153 of wall 151 contains a pair of half-circle cut-outs 155 that are arranged to mate with half-circle cut-outs 27 in wall edge 25 to form a pair of circular passageways for movement therethrough of drive belt 63. An upwardly bent lip 157 is placed along the rear edge of elongated openings 149 to aid in retaining the debris fragments and holding them away form rollers 53 during cleaning operations.

With the vacuum cleaner assembled and placed in operation, the damaging debris fragments will drop out of the air-debris stream into pan 135 to be held therein until emptied by removing pan 135. Access to removing belt 63 from pulley 67 is obtained by removal of pan 135.

What is claimed is:

1. An upright-type vacuum cleaner comprising:

(a) a base adapted for back-and-forth motion over the floor and having a cover thereover;

(b) an upright staff connecting said base to a push-pull handle and suspending therefrom an air-debris separator bag;

(c) rotary power means in said base with a vertically-oriented power shaft having upper and lower drive ends;

(d) floor vibrating means in said base, driven by said lower power shaft drive end, to aid in dislodging debris fragments from the floor;

(e) air pump means above said power means and connected to said upper power shaft drive end, having inlet and outlet ports respectively for receipt of debris-laden air from the floor and discharge thereof into said air-debris separator bag;

(f) an air duct forming, in cooperation with said base cover, an enclosed pathway from said floor vibrating means up over top of said power means into said air pump means inlet port and containing at least one radical change of upward airflow therebetween; and, (g) a receptacle in said air duct below said radical change of upward airflow for receipt therein of heavy debris fragments that drop out of the debris-laden airstream prior to entry into said air pump means to protect said air pump means from mechanical damage.

2. The vacuum cleaner of claim 1 including attachment hose connection means in said base cover immediately above said air pump means inlet port for direct connection between the vacuum cleaner attachment hose and said air pump means inlet port for increased vacuum power to the attachments.

3. The vacuum cleaner of claim 2 wherein said attachment hose connection means in said base cover comprises:

(a) a hollow collar forming an opening in said base cover, immediately above said air pump means inlet port, for receipt of the attachment hose;

(b) an annular depression formed, adjacent said collar, in said cover, such that the opening in said collar is maintained at least level with said base cover; and, (c) a detachable lid threadably received on said collar for detachment therefrom when the attachment hose is to be inserted therein.

4. The vacuum cleaner of claim 1 wherein said floor vibrating means comprises:

(a) a cylindrical roll of finite length and including a series of protuberances extending from the surface thereof and generally from one end to the other to produce vibration when rotated against the floor;

(b) support bearing means to rotatably mount said roller in said base transverse to the normal back-and-forth path of said base; and, (c) drive belt means stretched between said roller and said lower power shaft drive end to rotate said roller during cleaning operation.

5. The vacuum cleaner of claim 1 wherein said radical change of upward airflow in said air duct is accomplished by providing a downwardly extending baffle in said duct prior to said air pump means inlet port.

6. The vacuum cleaner of claim 1 wherein said receptacle comprises a pan, extending from around the underside edge of said floor vibrating means rearward to close with said air duct and containing an upwardly bent lip below said radical change of upward air flow and near said floor vibrating means to aid in retaining said large fragments of debris from re-entering said floor vibrating means.

7. An upright-type vacuum cleaner comprising:

(a) a base adapted for back-and-forth motion over the floor and having a cover threreover;

(b) a staff extending upright from hinged connection with said base to a push-pull handle and suspending therefrom an air-debris separator bag;

(c) an electric motor operably mounted in said base with a vertically-oriented rotating power shaft containing upper and lower drive ends;

(d) floor vibrating means including:

(1) a cylindrical roller of finite length and containing a series of protuberances extending from the surface thereof and generally from one end to the other to produce vibration when rotated against the floor;

(2) support bearing means to rotatably mount said roller in said base transverse to the normal back and forth path of said base; and, (3) drive belt means stretched between said roller and said lower power shaft drive end to rotate said roller during cleaning operation;

(e) a centrifugal air pump, positioned above said power means and connected to said upper power shaft drive end, having inlet and outlet ports respectively for receipt of debris-laden air from the floor and discharge thereof into said air separator bag;

(f) an air duct forming, in cooperation with said base cover, an enclosed pathway from said floor vibrating means up over top of said power unit into said air pump inlet port and containing a downwardly extending baffle therein to produce a radical change in upward airflow therein; and, (g) a receptacle in said air duct below said baffle comprising a pan, extending from around the underside edge of said roller rearward to close with said air duct, and containing an upwardly bent lip below said baffle and near said roller to aid in recovering and retaining heavy debris fragments that drop out of the debris-laden air stream prior to entry into said air pump.

8. The vacuum cleaner of claim 7 including attachment hose connection means in said base cover immediately above said centrifugal air pump inlet port for direct connection between the vacuum cleaner attachment hose and said centrifugal air pump inlet port for increased vacuum power to the vacuum cleaner attachments.

9. The vacuum cleaner of claim 8 wherein said attachment hose connection means in said base cover comprises:

(a) a hollow collar forming an opening in said base cover, immediately above said centrifugal air pump inlet port for receipt of the attachment hose;

(b) an annular depression formed, adjacent to said collar, in said cover, such that the opening in said collar is maintained at least level with said base cover; and, (c) a detachable lid threadably received on said collar for detachment therefrom when the attachment hose is to be inserted therein.

* * * * *

UNITED STATES PATENT AND TRADEMARK OFFICE

CERTIFICATE OF CORRECTION

PATENT NO. : 4,490,882

DATED : January 1, 1985

INVENTOR(S) : R. Leon Wells

It is certified that error appears in the above-identified patent and that said Letters Patent is hereby corrected as shown below:

On the title page;

The title, "UPRIGHT VACUUM CENTER" should read, "UPRIGHT VACUUM CLEANER".

Signed and Sealed this

*Twenty-third* Day of *July 1985*

[SEAL]

*Attest:*

DONALD J. QUIGG

*Attesting Officer*

*Acting Commissioner of Patents and Trademarks*